US011435125B2

(12) United States Patent
Cluff

(10) Patent No.: US 11,435,125 B2
(45) Date of Patent: Sep. 6, 2022

(54) HEATING COMPRESSOR AT START-UP

(71) Applicant: CARRIER CORPORATION, Palm Beach Gardens, FL (US)

(72) Inventor: Charles A. Cluff, Zionsville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 292 days.

(21) Appl. No.: 16/718,246

(22) Filed: Dec. 18, 2019

(65) Prior Publication Data

US 2020/0224947 A1 Jul. 16, 2020

Related U.S. Application Data

(60) Provisional application No. 62/791,059, filed on Jan. 11, 2019.

(51) Int. Cl.
*F25B 49/02* (2006.01)

(52) U.S. Cl.
CPC ..... *F25B 49/022* (2013.01); *F25B 2313/008* (2013.01); *F25B 2313/0316* (2013.01); *F25B 2400/01* (2013.01); *F25B 2500/26* (2013.01); *F25B 2700/2115* (2013.01)

(58) Field of Classification Search
CPC ..... F25B 49/022; F25B 2313/008; F25B 2313/0316; F25B 2400/01; F25B 2500/26; F25B 2700/2115
See application file for complete search history.

(56) References Cited

U.S. PATENT DOCUMENTS

| | | | |
|---|---|---|---|
| 2,107,887 | A | 2/1938 | Davenport |
| 3,133,429 | A | 5/1964 | Griffin |
| 3,705,499 | A | 12/1972 | Mount et al. |
| 4,066,869 | A | 1/1978 | Apoloo et al. |
| 4,236,379 | A | 12/1980 | Mueller |
| 4,888,957 | A | 12/1989 | Chmielewski |
| 5,062,277 | A | 11/1991 | Heitmann et al. |
| 5,230,222 | A | 7/1993 | Erbs |
| 5,369,958 | A | 12/1994 | Kasai et al. |
| 6,490,882 | B2 | 12/2002 | Tipton |

(Continued)

FOREIGN PATENT DOCUMENTS

| | | | |
|---|---|---|---|
| CN | 105466095 | A | 4/2016 |
| CN | 106440589 | A | 2/2017 |

(Continued)

OTHER PUBLICATIONS

"superheat, n.". OED Online. Dec. 2021. Oxford University Press, https://www.oed.com/view/Entry/314183?rskey=SrP0sk&result=1&isAdvanced=false (accessed Dec. 19, 2021). (Year: 2021).*

*Primary Examiner* — Larry L Furdge
*Assistant Examiner* — Alexis K Cox
(74) *Attorney, Agent, or Firm* — Carlson, Gaskey & Olds, P.C.

(57) ABSTRACT

A refrigerant system includes a compressor configured to pressurize a refrigerant fluid. The compressor includes a sump portion. A heater is situated to heat at least the sump portion. A controller is configured to selectively operate the heater to apply heat to at least the sump portion while the compressor is off and continue operating the heater when the compressor turns on until a temperature of the compressor or a temperature of fluid discharged from the compressor satisfies at least one criterion.

18 Claims, 2 Drawing Sheets

(56) References Cited

U.S. PATENT DOCUMENTS

| | | | | |
|---|---|---|---|---|
| 6,834,513 | B2 | 12/2004 | O'Brien et al. | |
| 6,886,354 | B2 | 5/2005 | Dudley | |
| 6,925,823 | B2 | 8/2005 | Lifson et al. | |
| 8,720,212 | B2 | 5/2014 | Wakuta et al. | |
| 8,734,125 | B2 | 5/2014 | McSweeney et al. | |
| 9,181,939 | B2 | 11/2015 | Pham | |
| 9,353,738 | B2 | 5/2016 | Ramayya | |
| 9,551,357 | B2 | 1/2017 | Waller | |
| 9,851,135 | B2 | 12/2017 | Pham | |
| 9,879,894 | B2 | 1/2018 | Ramayya | |
| 9,897,360 | B2 | 2/2018 | Yura | |
| 9,903,627 | B2 | 2/2018 | Fraser et al. | |
| 9,915,258 | B2 | 3/2018 | Perez et al. | |
| 9,939,184 | B2 | 4/2018 | Yura et al. | |
| 10,024,591 | B2 | 7/2018 | Goel et al. | |
| 10,047,965 | B2 | 8/2018 | Mackey et al. | |
| 10,119,734 | B2 | 11/2018 | Guldali et al. | |
| 2010/0125368 | A1* | 5/2010 | Bailey | F24F 11/30 700/276 |
| 2014/0000295 | A1 | 1/2014 | Schuster | |
| 2014/0138451 | A1* | 5/2014 | Pham | F04B 39/06 237/12 |
| 2015/0185197 | A1 | 7/2015 | Liang et al. | |
| 2015/0276276 | A1 | 10/2015 | Goel et al. | |
| 2015/0330651 | A1* | 11/2015 | Goel | F25B 49/022 700/276 |
| 2015/0330688 | A1* | 11/2015 | Goel | F25B 49/02 62/115 |
| 2016/0265798 | A1 | 9/2016 | Havard, Jr. et al. | |
| 2016/0327323 | A1 | 11/2016 | Goel | |
| 2017/0299240 | A1 | 10/2017 | Mercer | |
| 2018/0080694 | A1 | 3/2018 | Kihara et al. | |
| 2020/0248944 | A1* | 8/2020 | Cluff | F25B 40/06 |

FOREIGN PATENT DOCUMENTS

| | | | |
|---|---|---|---|
| CN | 107255069 | A | 10/2017 |
| EP | 2051024 | B1 | 6/2017 |
| WO | 2009/096620 | A1 | 8/2009 |

* cited by examiner

HEATING COMPRESSOR AT START-UP

CROSS REFERENCE TO RELATED APPLICATION

This application claims priority to U.S. Provisional Application No. 62/791,059, which was filed on Jan. 11, 2019.

BACKGROUND

Air conditioning and refrigeration systems are well known. A typical refrigerant circuit includes a compressor, a condenser, an expansion valve and an evaporator. While such circuits have proven useful and reliable, there are certain conditions that may occur that can adversely affect the system.

For example, under some conditions, such as at compressor start-up, it is possible for refrigerant fluid to condense inside the compressor. The condensed, liquid refrigerant may mix with oil in the compressor. One problem associated with such a mixture is that may develop into a foam and oil may be introduced into other portions of the circuit, which will deplete the oil in the compressor and increase the risk of damage or premature wear of compressor elements. Another problem that may arise is that the refrigerant may dilute the lubricating capacity of the oil, which is needed for proper compressor operation over time.

SUMMARY

An illustrative example embodiment of a refrigerant system includes a compressor configured to pressurize a refrigerant fluid. The compressor includes a sump portion. A heater is situated to heat at least the sump portion. A controller is configured to selectively operate the heater to apply heat to at least the sump portion while the compressor is off and continue operating the heater when the compressor turns on until at least one of a temperature of the compressor and a temperature of fluid discharged from the compressor satisfies at least one criterion.

In an embodiment having one or more features of the system of the previous paragraph, the at least one criterion includes the temperature of the fluid discharged from the compressor being at least a superheat temperature.

In an embodiment having one or more features of the system of any of the previous paragraphs, the at least one criterion includes the temperature of the compressor being above a threshold at which refrigerant fluid will not condense inside the compressor.

In an embodiment having one or more features of the system of any of the previous paragraphs, the compressor includes a shell and the temperature of the compressor is the temperature of the shell.

In an embodiment having one or more features of the system of any of the previous paragraphs, a speed of compressor operation is related to the temperature of the compressor and the controller is configured to continue operating the heater based on the speed of the compressor.

In an embodiment having one or more features of the system of any of the previous paragraphs, the controller is configured to operate the heater in a first mode to generate a first amount of heat for a first time while the compressor is on and in a second mode to generate a second amount of heat for a second time while the compressor is on.

In an embodiment having one or more features of the system of any of the previous paragraphs, the first amount of heat is greater than the second amount of heat.

In an embodiment having one or more features of the system of any of the previous paragraphs, the first time precedes the second time.

An illustrative example method of heating a compressor of a refrigerant system includes operating a heater for heating at least a sump portion of the compressor while the compressor is off and operating the heater when the compressor turns on for heating at least the sump portion until at least one of a temperature of the compressor and a temperature of fluid discharged from the compressor satisfies at least one criterion.

In an embodiment having one or more features of the method of the previous paragraph, the at least one criterion includes the temperature of the fluid discharged from the compressor being at least a superheat temperature.

In an embodiment having one or more features of the method of any of the previous paragraphs, the at least one criterion includes the temperature of the compressor being above a threshold at which refrigerant fluid will not condense inside the compressor.

In an embodiment having one or more features of the method of any of the previous paragraphs, the compressor includes a shell and the temperature of the compressor is the temperature of the shell.

An embodiment having one or more features of the method of any of the previous paragraphs includes monitoring a speed of compressor operation and operating the heater based upon the speed of the compressor.

An embodiment having one or more features of the method of any of the previous paragraphs includes operating the heater in a first mode to generate a first amount of heat for a first time while the compressor is on and in a second mode to generate a second amount of heat for a second time while the compressor is on.

In an embodiment having one or more features of the method of any of the previous paragraphs, the first amount of heat is greater than the second amount of heat.

In an embodiment having one or more features of the method of any of the previous paragraphs, the first time precedes the second time.

An illustrative example refrigerant system controller includes a processor that is configured to control operation of a compressor; selectively operate a heater to apply heat to at least a portion of the compressor while the compressor is off; and continue operating the heater when the compressor turns on until at least one of a temperature of the compressor and a temperature of fluid discharged from the compressor satisfies at least one criterion.

In an embodiment having one or more features of the controller of the previous paragraph, the at least one criterion includes at least one of the temperature of the fluid discharged from the compressor being at least a superheat temperature and the temperature of the compressor being above a threshold at which refrigerant fluid will not condense inside the compressor.

In an embodiment having one or more features of the controller of any of the previous paragraphs, the compressor includes a shell and the temperature of the compressor is the temperature of the shell.

In an embodiment having one or more features of the controller of any of the previous paragraphs, a speed of compressor operation is related to the temperature of the compressor; and the controller is configured to continue operating the heater based upon the speed of the compressor.

The various features and advantages of at least one disclosed example embodiment will become apparent to those skilled in the art from the following detailed description. The drawings that accompany the detailed description can be briefly described as follows.

DETAILED DESCRIPTION

Figure 1:
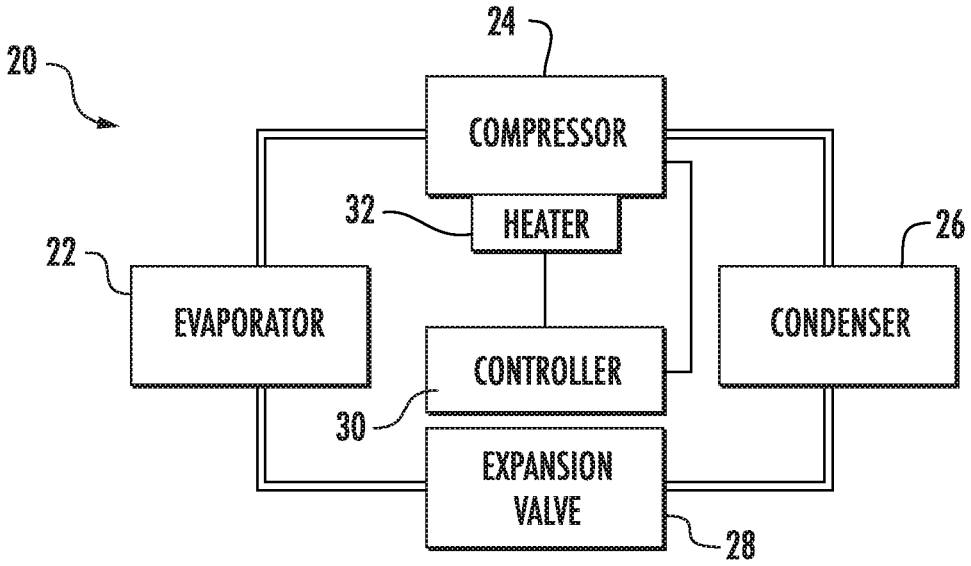
FIG. 1 schematically illustrates selected portions of a refrigerant system according to an embodiment of the present disclosure.

FIG. 1 schematically illustrates a system 20 that includes a refrigerant circuit capable of providing air conditioning or refrigeration, for example. The refrigerant circuit includes an evaporator 22, a compressor 24, a condenser 26 and an expansion valve 28 that operate in a known manner. In some implementations, the evaporator 22 is configured to be situated within a temperature conditioned space, such as a building or a residence and the condenser 26 is configured to be situated outside the space.

A controller 30, which includes a processor or another computing device and memory, is configured to control operation of the compressor. In some situations, the compressor 24 remains idle or inoperative. Under certain circumstances, such as when cooling is needed, the controller 30 turns on the compressor 24 and causes it to operate such that the compressor 24 pressurizes refrigerant fluid within the circuit in a known manner.

A heater 32 is associated with the compressor 24. In the illustrated example system, the compressor 24 includes a sump portion and the heater 32 is situated to heat at least the sump portion of the compressor 24. The controller 30 is configured to selectively operate the heater 32. While the compressor 24 is off, the controller 30 causes the heater 32 to operate to maintain a preselected minimum temperature of at least the sump portion of the compressor 24.

Figure 2:
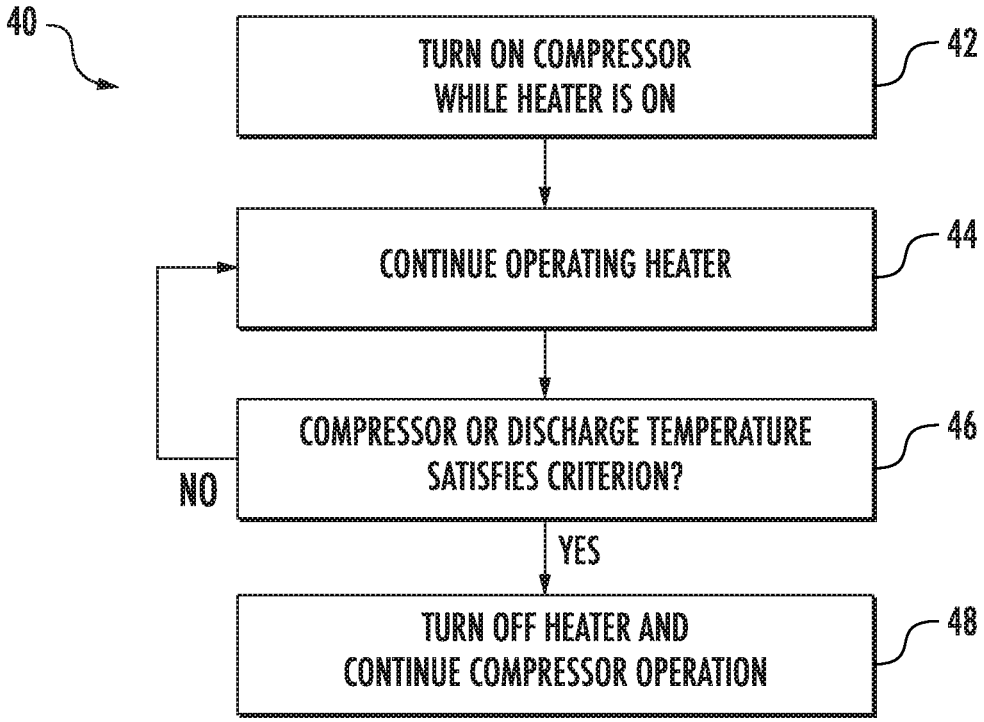
FIG. 2 is a flow chart diagram summarizing an example control method according to an embodiment of the present disclosure.

The controller 30 is also configured to operate the heater 32 during a compressor start-up. FIG. 2 is a flowchart diagram 40 that summarizes an example control strategy. At 42, the compressor 24 turns on while the heater 32 is on. At 44, the controller 30 continues the operation of the heater 32. At 46, the controller 30 determines whether to continue heating the compressor 24 by the heater 32 based on at least one criterion. In the illustrated example, the controller 30 determines if at least one temperature associated with the compressor 24 reaches a threshold.

For example, the controller 30 monitors a temperature of a shell of the compressor 24. As heated refrigerant vapor contacts the interior of the compressor shell, the refrigerant vapor may condense on the inside of the shell if the shell is sufficiently cooler than the refrigerant vapor. Monitoring the shell temperature and controlling the heater 32 to increase or maintain the temperature of the shell assists in avoiding such condensation. The temperature of the shell of the compressor 24 is useful when the compressor is a so-called high side compressor and the pressure within the shell is the same as the discharge pressure of the compressor.

The controller 30, in some embodiments, monitors the temperature of the sump portion of the compressor 24 and determines whether the sump temperature is above or below a preselected threshold.

Another example criterion includes a temperature of refrigerant fluid discharged by the compressor 24. The discharge temperature provides an indication of conditions within the compressor 24. For example, once the discharge temperature reaches a superheat level the compressor 24 has reached a point at which no additional heat is needed and the controller 30 turns off the heater 32.

In some embodiments, the controller 30 monitors a discharge pressure of the refrigerant exiting the compressor 24 to determine a corresponding discharge temperature. The controller 30 determines whether that temperature exceeds a corresponding threshold temperature.

The threshold temperature for each of the example criterion that will be useful for a particular refrigerant circuit or compressor may be determined by one of skill in the art who has the benefit of this description.

As long as the compressor shell temperature or the discharge temperature of the refrigerant is below a corresponding threshold, the controller 30 continues operating the heater 32 while the compressor 24 operates. Once at least one of an appropriate shell temperature or discharge temperature is established, the controller 30 turns off the heater 32 at 48.

In some embodiments, the controller 30 coordinates control of the heater 32 with control of compressor speed. Some compressors have a relatively slower start-up speed, such as 3000 rpm, that eventually increases to a higher speed, such as 6000 rpm, as the compressor warms up. The controller 30 determines how to control continued operation of the heater 32 based on the compressor speed. In some example embodiments, the controller 30 at least slows down the heater as the compressor speed increases. Some example controllers 30 turn off the heater 32 once the compressor 24 is at full speed.

The controller 30, in some embodiments, uses a combination of at least two of the criterion discussed above to control whether the heater 32 remains on during compressor operation.

Figure 3:
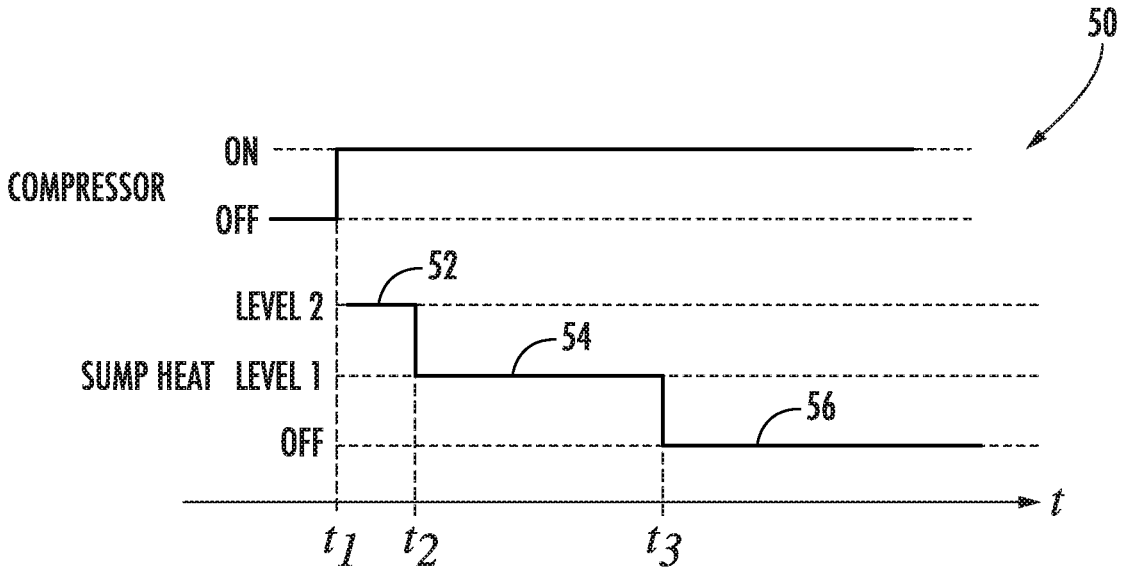
FIG. 3 is a timing diagram showing compressor heater control, according to an embodiment of the present disclosure.

FIG. 3 illustrates another aspect of some example embodiments. The timing diagram 50 show the compressor turning on at a time t1. The heater 32 was already operating at a first level or in a first mode providing a first amount of heat as shown at 52. Later at a time t2, the controller 30 determines that a temperature associated with the compressor 24 has reached a sufficient level; thus, less heating is required from the heater 32. At the time t2, the controller 30 cause the heater 32 to operate in a second mode or at a second level shown at 54 where the heater 32 provides a second, lesser amount of heat. The heater 32 continues to operate at the second level until the controller 30 shuts the heater 32 off at a time t3 as shown at 56. The time t3 coincides with the temperature monitored by the controller 30 satisfying the criterion or criteria that indicate when the compressor temperature conditions are such that additional heat is no longer needed. Operating the heater 32 at different levels allows for realizing energy savings while still providing a compressor heating function during compressor operation to reduce or eliminate a risk of refrigerant condensation near compressor start-up.

The various features of the example embodiments described above may be combined in various ways to realize further embodiments. Whichever of the features are chosen, the controller 30 causes the heater 32 to continue operating during compressor start-up and for a sufficient time to achieve temperature conditions associated with the compressor 24 to protect against refrigerant condensation.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. A refrigerant system, comprising:

a compressor configured to pressurize a refrigerant fluid, the compressor including a sump portion;

a heater situated to heat at least the sump portion; and a controller that is configured to selectively operate the heater to apply heat to at least the sump portion while the compressor is off, continue operating the heater when the compressor turns on until at least one of a temperature of the compressor and a temperature of fluid discharged from the compressor satisfies at least one criterion, operate the heater in a first mode to generate a first amount of heat for a first time while the compressor is on, and operate the heater in a second mode to generate a second amount of heat for a second time while the compressor is on.

2. The refrigerant system of claim 1, wherein the at least one criterion comprises the temperature of the fluid discharged from the compressor being at least a superheat temperature.

3. The refrigerant system of claim 1, wherein the at least one criterion comprises the temperature of the compressor being above a threshold at which refrigerant fluid will not condense inside the compressor.

4. The refrigerant system of claim 3, wherein the compressor includes a shell and the temperature of the compressor is the temperature of the shell.

5. The refrigerant system of claim 1, wherein a speed of compressor operation is related to the temperature of the compressor; and the controller is configured to continue operating the heater based on the speed of the compressor.

6. The refrigerant system of claim 1, wherein the first amount of heat is greater than the second amount of heat.

7. The refrigerant system of claim 6, wherein the first time precedes the second time.

8. A method of heating a compressor of a refrigerant system, the method comprising: operating a heater for heating at least a sump portion of the compressor while the compressor is off;

operating the heater when the compressor turns on for heating at least the sump portion until at least one of a temperature of the compressor and a temperature of fluid discharged from the compressor satisfies at least one criterion;

operating the heater in a first mode to generate a first amount of heat for a first time while the compressor is on; and operating the heater in a second mode to generate a second amount of heat for a second time while the compressor is on.

9. The method of claim 8, wherein the at least one criterion comprises the temperature of the fluid discharged from the compressor being at least a superheat temperature.

10. The method of claim 8, wherein the at least one criterion comprises the temperature of the compressor being above a threshold at which refrigerant fluid will not condense inside the compressor.

11. The method of claim 10, wherein the compressor includes a shell and the temperature of the compressor is the temperature of the shell.

12. The method of claim 8, comprising:

monitoring a speed of compressor operation; and operating the heater based upon the speed of the compressor.

13. The method of claim 8, wherein the first amount of heat is greater than the second amount of heat.

14. The method of claim 13, wherein the first time precedes the second time.

15. A refrigerant system controller comprising a processor that is configured to control operation of a compressor;

selectively operate a heater to apply heat to at least a portion of the compressor while the compressor is off;

continue operating the heater when the compressor turns on until at least one of a temperature of the compressor and a temperature of fluid discharged from the compressor satisfies at least one criterion;

operate the heater in a first mode to generate a first amount of heat for a first time while the compressor is on, and operate the heater in a second mode to generate a second amount of heat for a second time while the compressor is on.

16. The refrigerant system controller of claim 15, wherein the at least one criterion comprises at least one of the temperature of the fluid discharged from the compressor being at least a superheat temperature;

the temperature of the compressor being above a threshold at which refrigerant fluid will not condense inside the compressor.

17. The refrigerant system controller of claim 15, wherein the compressor includes a shell and the temperature of the compressor is the temperature of the shell.

18. The refrigerant system controller of claim 15, wherein a speed of compressor operation is related to the temperature of the compressor; and the controller is configured to continue operating the heater based upon the speed of the compressor.

* * * * *